US005911264A

United States Patent [19]

Smrke et al.

[11] Patent Number: 5,911,264

[45] Date of Patent: Jun. 15, 1999

[54] HINGE PIN RAMP, RETAINER AND DOORSTOP FOR A FRAME DOOR

[75] Inventors: Gregory M. Smrke, Etobicoke; Alex K. Tang, Mississauga; Paul A. van Leeuwen, Toronto, all of Canada

[73] Assignee: Northern Telecom Limited, Montreal, Canada

[21] Appl. No.: 08/980,761

[22] Filed: Dec. 1, 1997

[51] Int. Cl.[6] ..... E05D 7/10

[52] U.S. Cl. ..... 16/258; 49/388

[58] Field of Search ..... 16/258, 257, 268, 16/262, 229–232, 254, 272, 374, 376–380, 249; 220/338, 337; 248/188.8, 527, 539; 49/388

[56] References Cited

U.S. PATENT DOCUMENTS

| | | | |
|---|---|---|---|
| 318,288 | 5/1885 | Perkins | 16/239 |
| 3,117,827 | 1/1964 | Cecala | 16/275 |
| 3,222,711 | 12/1965 | Cecala | 16/275 |
| 3,229,323 | 1/1966 | Hensgen | 16/247 |
| 3,371,506 | 3/1968 | Zahn | 16/257 |
| 3,863,391 | 2/1975 | Horvay et al. . | |
| 4,021,882 | 5/1977 | Polanco . | |
| 4,151,681 | 5/1979 | Roberts . | |
| 4,215,449 | 8/1980 | Loikitz . | |
| 5,008,975 | 4/1991 | Wang et al. | 16/266 |

OTHER PUBLICATIONS

Excerpt (2 pages) from Eberhard Catalogue, Eberhard Hardware Manufacturing Limited, Industrial and Vehicular Hardware, Tillsonburg, Ontario, Canada, 1997.

*Primary Examiner*—Chuck Y. Mah

[57] ABSTRACT

A hinge pin ramp, retainer and doorstop for a frame door. The ramp, retainer and doorstop is formed into a hinge pin receptacle which allows closing or installing a frame door simply by pushing on it. A spring-loaded door pin is received by the hinge pin ramp and guided into the hinge pin retainer. There are also provided accordion shims to assist with levelling the door during installation.

10 Claims, 5 Drawing Sheets

HINGE PIN RAMP, RETAINER AND DOORSTOP FOR A FRAME DOOR

FIELD OF INVENTION

The present invention relates to a hinge pin ramp, retainer and doorstop for a frame door and is particularly concerned with a hinge pin receptacle that accepts a spring-loaded pin in order to mount or to close a frame door.

BACKGROUND OF THE INVENTION

Frames for electronic devices often have doors. The doors must be capable of opening and closing and must be easy to install. As well, it is desirable that doors can be closed simply by pushing on them.

SUMMARY OF THE INVENTION

An object of the present invention is to provide an integrated hinge pin, retainer and doorstop for a frame door.

An advantage of the present invention is that it allows a frame door to be easily installed and allows for the closure of an associated frame door with a simple push action.

In one aspect there is provided a hinge pin receptacle comprising a body defining a slot; said slot for receiving a door pin; a ramp in said body; said ramp for guiding the door pin into said slot; means for fastening said body to a door frame adaptor.

BRIEF DESCRIPTION OF DRAWINGS

The invention will be further understood from the following description with references to the drawings in which.

DETAILED DESCRIPTION OF THE PREFERRED EMBODIMENTS

Figure 1:
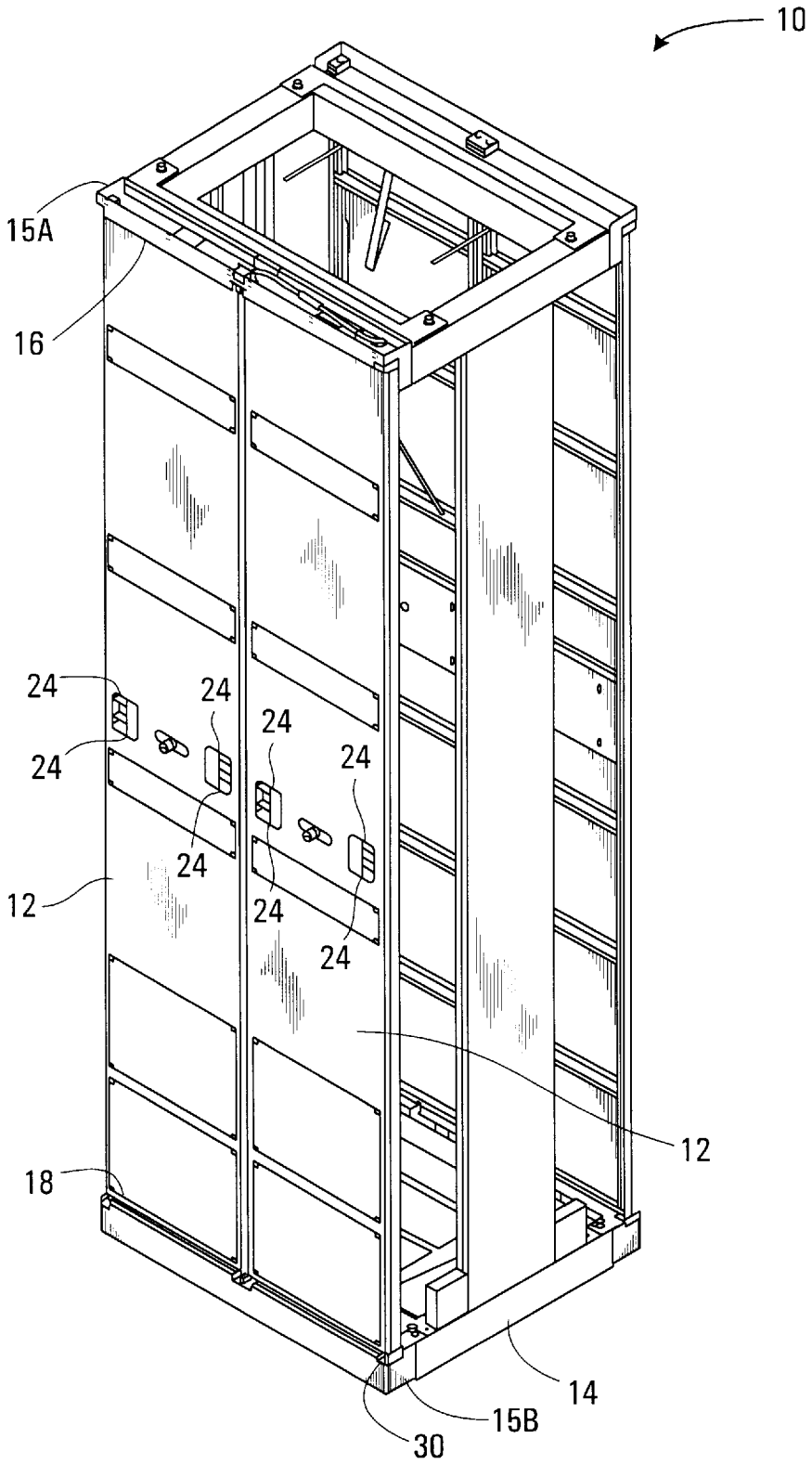
FIG. 1 is a perspective view of a frame door in accordance with an embodiment of the present invention.

FIG. 1 shows a frame 10 in accordance with one embodiment of the present invention. Frame 10 has doors 12 which are mounted at front edge 14 of the frame 10, via top adaptor 15*a* and bottom adaptor 15*b*. Protruding from top edge 16 and bottom edge 18 of door 12 are spring-loaded pins. The spring-loaded pins are not visible in FIG. 1. The spring-loaded pins are biased to protrude from top-edge 16 and bottom-edge 18. The pins are retracted by pulling on handles

24 attached to the pins by means of a linking mechanism. In this manner the door can be opened.

The spring-loaded pins fit into the hinge pin receptacle 30. The hinge pin receptacle 30 is fastened to frame 10 near the front edge 14, via top adaptor 15*a* and bottom adaptor 15*b*.

Figure 2:
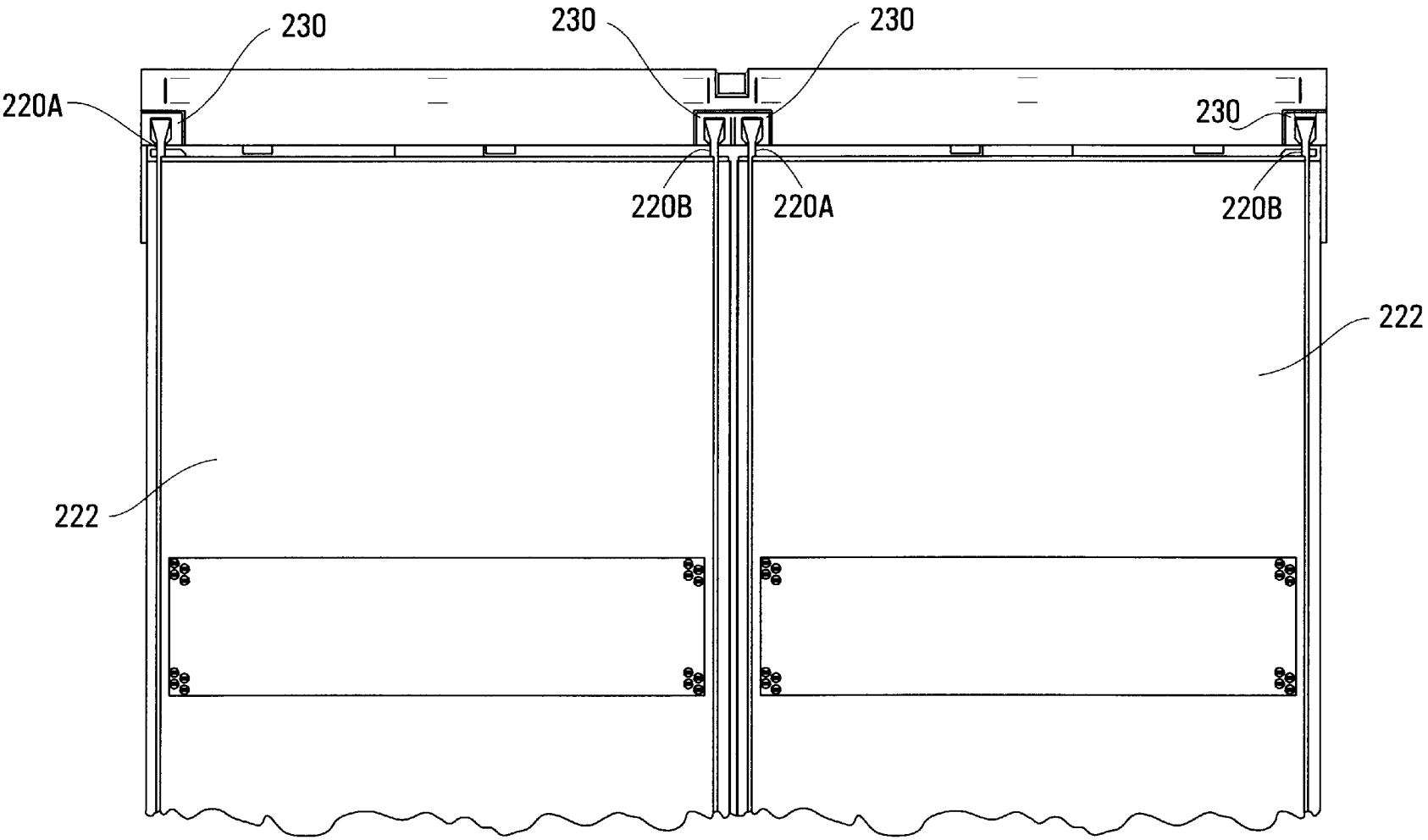
FIG. 2 is a front view of a upper portion of a frame in accordance with another embodiment of the present invention.

As shown in FIG. 2, each door 222 has hinge pins 220*a*, 220*b* at its left and right side. In this way the door is capable of being supported by left hinge pins 220*a* or by right hinge pins 220*b*. The hinge pins 220*a*, 220*b* fit into hinge pin receptacle 230.

Figure 3A:
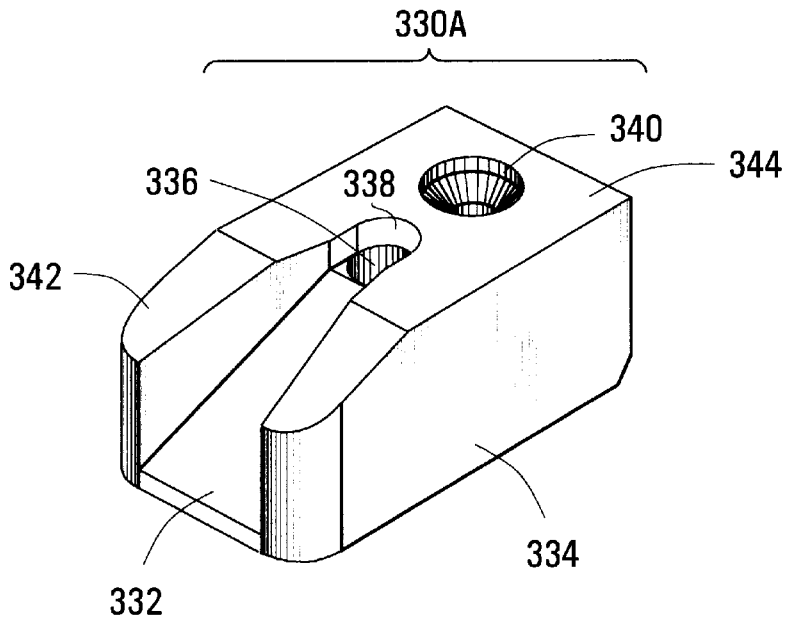
FIG. 3*a* is a top perspective view of an integrated hinge pin receptacle in accordance with an embodiment of the present invention.
Figure 3B:
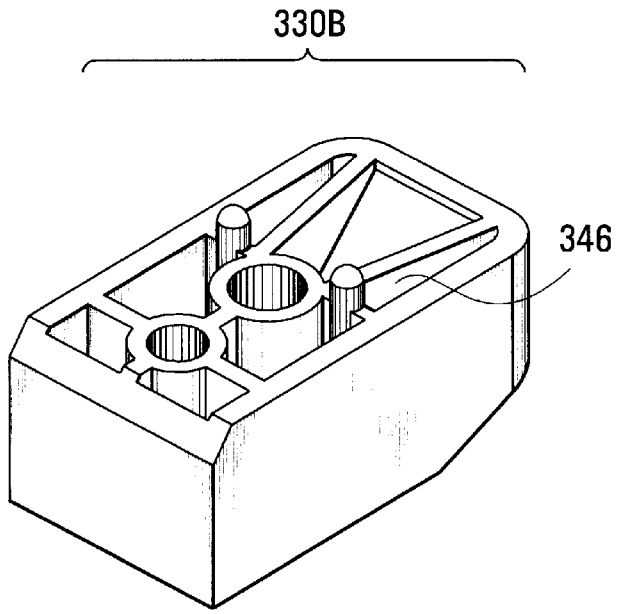
FIG. 3*b* is a bottom perspective view of an integrated hinge pin receptacle in accordance with an embodiment of the present invention.

FIGS. 3*a*, 3*b* show a detailed view of a hinge pin receptacle 330*a*, 330*b*. As shown in FIG. 3*a*, the hinge pin receptacle 330*a* has a ramp 332 to receive a spring-loaded pin. Although as shown in FIG. 3*a* the ramp is inclined, as will be apparent from other figures and embodiments, the ramp may be horizontal in some embodiments. The body 334 of the hinge pin receptacle 330*a* defines a hole 336 which receives a spring-loaded pin. When a spring-loaded pin is retained in hole 336 the pin and hole 336 act as a top or bottom hinge for the door attached to the pin. Hole 336 has a back portion 338 which prevents further rearwards movement of the pin. The hinge pin receptacle 330*a* is fastened to the top adaptor and bottom adaptor by placing a screw through bevelled hole 340 defined in body 334. Alternatively it could be fastened by way of clips or some other fastening mechanism known to those skilled in the art.

Body 334 also has sloped front edge 342, which can receive or guide the bottom or top edge of the door onto the top surface 344 of hinge pin receptacle 330*a*. This makes it easier to push-close the door if the door edge is not level with top surface 344.

As shown in FIG. 3*b*, the bottom surface of hinge pin receptacle 330*b* has protrusions 346 which may be received by holes in the top adaptor or bottom adaptor for easier mounting and assembly.

Figure 4:
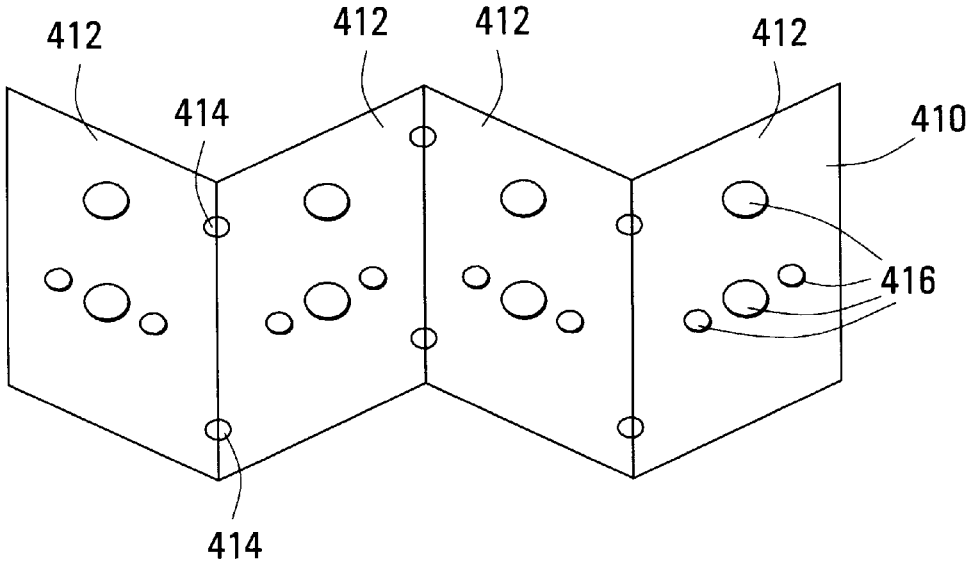
FIG. 4 is a perspective view of an accordion shim for use in another embodiment of the present invention.

FIG. 4 shows a perspective view of an accordion shim 410, leaves 412 of shim 410 are attached by breakable hinge 414. Leaves 412 also define holes or apertures 416 that can receive protrusions from the bottom surface of a hinge pin receptacle. Apertures 416 can also receive spring-loaded pins or fasteners. A shim 410 is inserted between top or bottom adaptors such as 15*a* and 15*b* in FIG. 1 and the hinge pin receptacle to ensure that the door is supported on both left and right hinge pin receptacles, to make door opening and closing feel the same for both sides of the door. As will be apparent to those skilled in the art, other means could be used, instead of shims, to accomplish height adjustment. Breakable hinges 414 can be broken to give the desired shim thickness.

A benefit of the present invention is that the door may be closed simply by pushing on it. Spring-loaded pins are guided up ramp 332, stopped by back portion 338 and drop into hole 336, thereby locking the door. As well, during installation of a door, the ramp 332 and back portion 338 guide pins into hole 336, making initial installation of the door easier.

Figure 5:
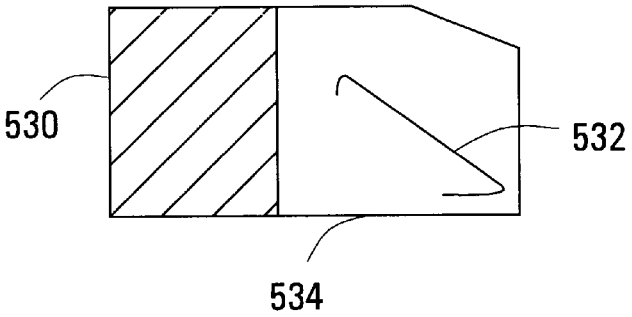
FIG. 5 is a side sectional view of an integrated hinge pin receptacle in accordance with another embodiment of the present invention.

An alternative embodiment of the present invention is shown in FIG. 5. Hinge pin receptacle 530 has a biased ramp 532, which receives a spring-loaded pin which protrudes from a door. However, because biased ramp 532 can move when it comes into contact with the pin, the pin could remain fixed in position as the door closes. The pin could remain fixed in position if the handle associated with the pin was locked into an extended position with a locking mechanism or if the handle and pin did not move freely. As shown in FIG. 5, ramp 532 could be biased by forming it from a piece of spring steel and attaching it to a lower edge 534 of hinge pin receptacle 530.

Figure 6:
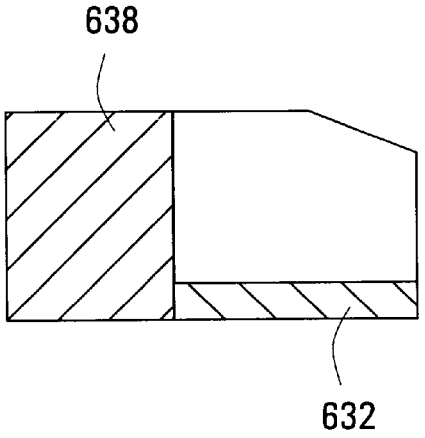
FIG. 6 is a side sectional view of an integrated hinge pin receptacle in accordance with another embodiment of the present invention.

Yet another embodiment of the present invention is shown in FIG. 6. As shown in FIG. 6 the ramp 632 is horizontal. Retention means as explained below can be used to hold the pin against back portion 638 which acts as a doorstop for the pin. The retention means allow the door to be closed and held shut simply by pushing on the door.

Figure 6A:
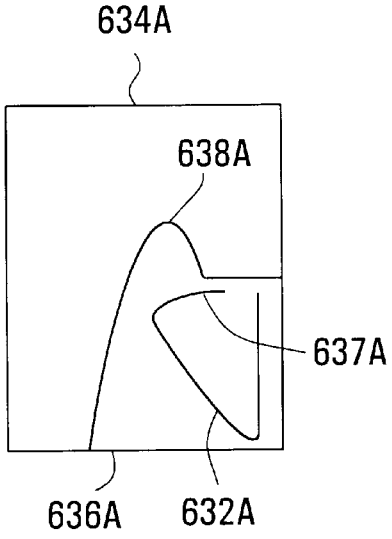
FIGS. 6A–6D are top views of integrated hinge pin receptacles in accordance with other embodiments of the present invention.

As shown in FIG. 6A the body 634*a* of the hinge pin receptacle defines an opening 636*a* which receives a spring loaded pin. Along one side of the opening 636*a* is a retention means, such as spring 637*a*. When the door is closed, the pin pushes against a front sloped surface 632*a* of spring 637*a* until the pin is proximate back portion 638*a*, when the spring 637*a* snaps back to its original position.

Figure 6B:
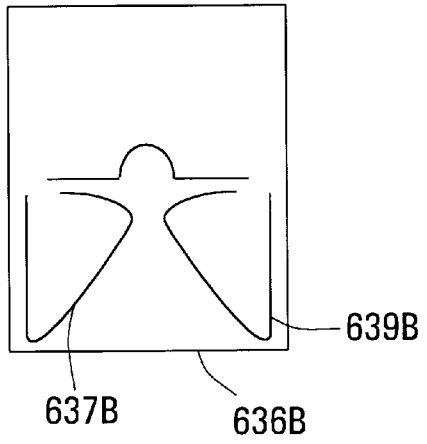

As shown in FIG. 6B, there could be both a first spring 637*b* and a second spring 639*b* on either side of opening 636*b*.

Figure 6C:
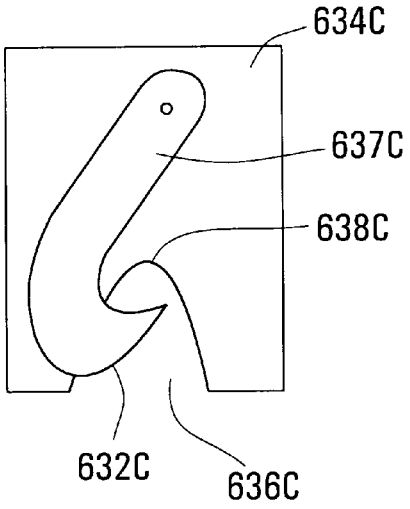

As shown in FIG. 6C, biased hook 637*c* is pivotally mounted to the body 634*c* of the hinge pin receptacle. Hook 637*c* has a sloped front surface 632*c* which causes hook 637*c* to rotate when a pin is pushed against it. When the pin is proximate back portion 638*c*, the hook 637*c* snaps back to its original position because it is biased towards the original position.

Figure 6D:
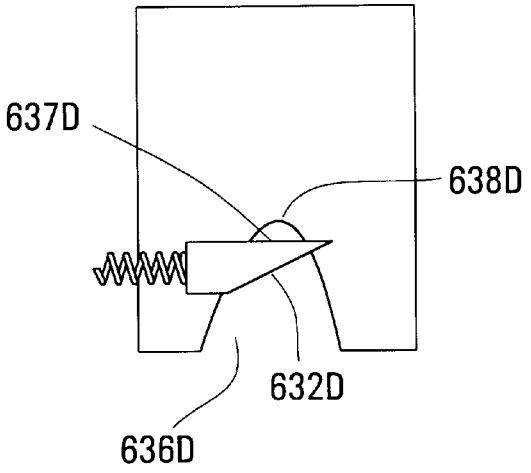

Alternatively, as shown in FIG. 6D, a spring-loaded plunger 637*d* can be placed at the side of opening 636*d*. Spring-loaded plunger 637*d* has a sloped front surface 632*d*. When a pin is pushed against plunger 637*d* the pin comes into contact with sloped front surface 632*d* and pushes spring-loaded plunger 637*d* out of the way until the pin is proximate back portion 638*d*, when spring-loaded plunger 637*d* snaps back into position.

Numerous modifications, variations and adaptations may be made to the particular embodiments of the invention described above without departing from the scope of the invention which is defined in the claims.

What is claimed is:

1. A hinge pin receptacle comprising:

a body defining a slot;

said slot for receiving a door pin;

a ramp fixed in position in said body;

said ramp for guiding the door pin into said slot;

means for fastening said body to a door frame adaptor.

2. The hinge pin receptacle claimed in claim 1, wherein:

said body has a front surface; and said ramp starts at said front surface and ends at said slot.

3. The hinge pin receptacle claimed in claim 2, wherein:

said ramp slopes upwardly from said front surface to said slot.

4. The hinge pin receptacle claimed in claim 3 wherein:

said ramp is centred on a longitudinal axis of said body.

5. The hinge pin receptacle claimed in claim 1 wherein said body has a sloped front edge for guiding a door onto a top surface of said body.

6. The hinge pin receptacle claimed in claim 1 wherein the means for fastening is a second slot for receiving a screw.

7. A hinge pin receptacle comprising:

a body defining a slot;

said slot for receiving a door pin;

a ramp in said body;

said ramp for guiding the door pin into said slot;

means for fastening said body to a door frame adaptor;

an accordion shim;

said accordion shim defining apertures corresponding to a plurality of apertures in a bottom surface of said body;

said shim having a plurality of adjacent leaves joined by a breakable hinge; and said plurality of adjacent leaves having the same dimensions.

8. A hinge pin receptacle comprising:

a body defining a slot;

said slot for receiving a door pin;

a ramp in said body;

said ramp for guiding the door pin into said slot;

said ramp starting at said front surface and ends at said slot;

said body having retention means proximate to said ramp;

said retention means comprising:

a first spring;

said first spring attached to said body along a first side of said ramp;

said first spring having a sloped front surface; and, means for fastening said body to a door frame adaptor.

9. The hinge pin receptacle claimed in claim 8 wherein said retention means further comprises:

a second spring;

said second spring attached to said body along a second side of said ramp; and said second spring having a second sloped front surface.

10. A hinge pin receptacle comprising:

a body defining a slot;

said slot for receiving a door pin;

a ramp in said body;

said ramp starting at a front surface of said body and ending at said slot;

a retention means comprising:

said hook pivotally mounted on said body;

said hook having a sloped front surface;

said hook biased to return to an original position.

* * * * *